US006164093A

United States Patent [19]

Seki

[11] Patent Number: 6,164,093

[45] Date of Patent: Dec. 26, 2000

[54] KNIT NECKTIE AND METHOD OF PRODUCING THE SAME

[75] Inventor: Akiyoshi Seki, Kawagoe, Japan

[73] Assignee: Tokyo Knitting Machine Supply Co., Ltd., Tokyo, Japan

[21] Appl. No.: 09/302,873

[22] Filed: Apr. 30, 1999

[30] Foreign Application Priority Data

Apr. 30, 1998 [JP] Japan ..... 10-121510

[51] Int. Cl.[7] ..... D04B 1/00

[52] U.S. Cl. ..... 66/170; 66/58; 66/8; 66/148; 66/178; 2/147

[58] Field of Search ..... 66/8, 30, 37, 46, 66/51, 56, 79, 89, 178 R, 171, 193, 196; 2/147, 58, 170

[56] References Cited

U.S. PATENT DOCUMENTS

| | | | |
|---|---|---|---|
| 1,073,050 | 9/1913 | Kellinger et al. | 2/147 |
| 1,219,084 | 3/1917 | Church et al. | 2/147 |
| 1,516,931 | 2/1924 | Seidman | 2/147 |
| 5,647,229 | 7/1997 | Conti | 66/58 |
| 5,727,400 | 3/1998 | Lonati et al. | 66/148 |

*Primary Examiner*—John J. Calvert
*Assistant Examiner*—Robert Moromoto, Jr.
*Attorney, Agent, or Firm*—Hogan & Hartson, LLP

[57] ABSTRACT

A knit necktie which is entirely formed from a tubular knit fabric knitted continuously and has a triangular apron tipping portion which is formed from a triangular bag-shaped knit fabric formed by raising needles in a semicircle of a circular knitting machine to a non-knitting level and starting semicircle knitting by forward and reverse rotation of a cylinder, decreasing stitches one by one stitch on each of the opposite left and right sides for each one forward and reverse rotation, repeating the decreasing step until only two central stitches remain, thereafter increasing the stitches one by one stitch on each of the opposite left and right sides for each one forward and reverse rotation of the cylinder, and repeating the increasing step.

3 Claims, 2 Drawing Sheets

KNIT NECKTIE AND METHOD OF PRODUCING THE SAME

BACKGROUND OF THE INVENTION a. Field of the Invention

This invention relates to a knit necktie and a method of producing the same.

b. Prior Art

In production of a knit necktie which is generally used conventionally, using a small circular knitting machine of a single cylinder type, a knitting yarn and a knitting texture are changed over to successively knit a rear apron portion, a neckband portion and a front apron portion into tubular knit fabrics having different widths from each other, and in a later step, an opening at an end portion of the front apron side is seamed with inside out to close up the same and simultaneously form an apron tipping portion of a triangular or rectangular shape.

Consequently, the end portion of the necktie becomes thicker than the other portion and it is difficult to form a sharp apron tipping portion. Besides, the special seaming step described above must be involved, and the process of production is complicated.

SUMMARY OF THE INVENTION

In view of the foregoing of a conventional knit necktie, the present invention has been made in order to obtain a knit necktie and a method of producing the same wherein formation of an apron tipping portion of a triangular shape is performed automatically in a knitting process and it is possible to omit a seaming step and simplify a later step.

A knit necktie which is entirely formed from a tubular knit fabric knitted continuously and has a triangular apron tipping portion at an end thereof is constructed such that the apron tipping portion is formed from a triangular bag-shaped knit fabric formed by raising needles in a semicircle of a circular knitting machine, which knits a tubular knit fabric, to a non-knitting level and starting semicircle knitting by forward and reverse rotation of a cylinder, decreasing stitches one by one stitch on each of the opposite left and right sides for each one forward and reverse rotation, repeating the decreasing step until only two central stitches remain, thereafter increasing the stitches one by one stitch on each of the opposite left and right sides for each one forward and reverse rotation of the cylinder, and repeating the increasing step until all of the needles in the semicircle come to a knitting position. Preferably, an end of the knit fabric on the rear face side of the apron tipping portion and an end of the knit fabric on the rear face side of the tubular knit fabric which does not continue to the apron tipping portion are linked to each other and closed by linking. Further, as a method of producing the knit necktie described above, a method of producing a knit necktie wherein, using a hosiery knitting machine, a rear apron portion, a neckband portion and a front apron portion are knitted continuously in a tubular knit fabric, needles in a semicircle corresponding to a rear face side of the front apron portion are raised to a non-knitting level and semicircle knitting by forward and reverse rotation of a cylinder is started, stitches are decreased one by one stitch on each of the opposite left and right sides for each one forward and reverse rotation, the decreasing step is repeated until only two central stitches remain, thereby to knit a front side portion of the apron tipping portion, the stitches are thereafter increased one by one stitch on each of the opposite left and right sides for each one forward and reverse rotation of the cylinder, the increasing step is repeated until all of the needles in the semicircle come to a knitting position, thereby to knit a rear side portion of the apron tipping portion integral with the front side portion of the apron tipping portion, thereby forming the apron tipping portion composed of a triangular bag-shaped knit fabric, the needles in the semicircle which have been raised to the non-knitting level are returned to the knitting level, a waste course portion composed of a short tubular knit fabric connecting to the rear side portion of the apron tipping portion and the rear face side portion of the front apron portion is knitted by full rotation, the knit fabric portions connecting to the waste course portion are set to a linking machine, the waste course portion is cut away, and the knit fabric portions are linked to each other, is adopted.

DESCRIPTION OF THE PREFERRED EMBODIMENTS

Figure 1:
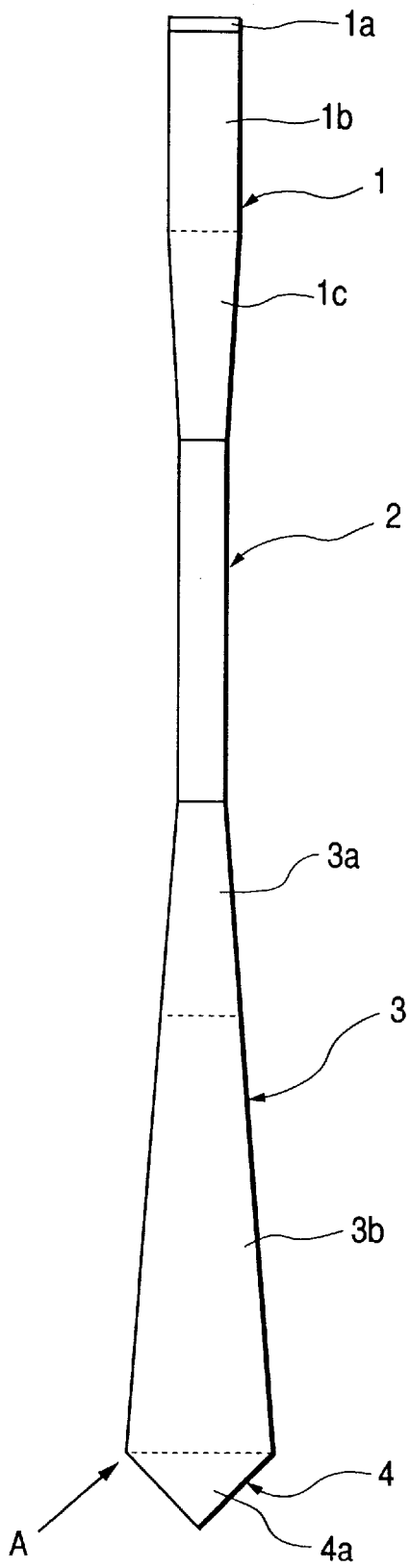
FIG. 1 is a schematic front elevational view showing a knit necktie of an embodiment of the present invention.

FIG. 1 is a schematic view showing a knit necktie of an embodiment of the present invention. Referring to FIG. 1, the knit necktie is composed principally of a rear apron portion 1, a neckband portion 2, a front apron portion 3 arid an apron tipping portion 4 at an end of the front apron portion and is entirely formed from tubular knit fabrics knitted successively. In the following, a detailed construction of it is described in accordance with a knitting procedure.

The knit necktie of the present invention is knitted by a single cylinder hosiery knitting machine fully controlled by a computer. In the knitting procedure, knitting is started with an end portion 1*a* of the rear apron portion 1 first with a rubber yarn inserted therein, and then the insertion of the rubber yarn is stopped to knit the rear apron portion 1. The rear apron portion 1 is knitted, at a free end side portion 1*b*, parallelly with a fixed knitting width in an intermediate density, but at a base end side portion 1*c*, the density is successively increased to gradually decrease the width of the knit fabric as seen in FIG. 1 so that it is knitted to have a tapering profile.

Then, the knitting yarn is changed over to another yarn of a relatively low count and the neckband portion 2 is knitted with a fixed small width with the density kept to the highest, and then, the knitting yarn is changed over to a different yarn of a count substantially equal to that of the rear apron portion 1 to knit a base end side portion 3*a* of the front apron portion 3. At the base end side portion 3*a*, the density is successively decreased gradually contrary to that at the base end side portion 1*c* of the rear apron portion described hereinabove to gradually increase the width of the knit fabric so that it is knitted to have a tapering profile.

Then, when knitting comes to a central portion 3*b* of the front apron portion 3, the knitting yarn is changed over to a further yarn of a further relatively high count while the density is increased to prevent a sudden dimensional variation at the changed over portion, whereafter the density is decreased gradually so that the knit 3*b* is knitted to have a tapering profile. By such density adjustment and changing over of the count of yarn, also a necktie having a configuration like a neck of bottle can be knitted.

While the foregoing knitting is all performed by full rotation of the cylinder, when knitting comes to a boundary portion to the apron tipping portion 4, those needles (for example, long butt needles) in a semicircle of the cylinder which corresponds to the rear face side of the front apron portion 3 are raised to a non-knitting level (top face of the center cam) by a switch cam (not shown) while rotation of the cylinder is simultaneously changed over from full rotation to forward and backward rotation and semicircle knitting by those needles in the remaining semicircle is started.

Thereafter, similarly as upon formation of a heel pocket of a sock or stocking, knitting is performed while one needle on each of the opposite left and right sides is raised to the non-knitting level by an up picker for each forward and backward rotation of the cylinder to decrease stitches one by one stitch until only two central knitting needles remain, thereby to knit a front side portion 4*a* of the apron tipping portion 4.

Then, in parallel with the operation of the up pickers described above, knitting is continued while down pickers are operated, for each one forward and reverse rotation of the cylinder, such that the needles at the non-knitting level are lowered two by two needles on the opposite left and right sides by the down pickers so that stitches are increased one by one stitch by a deduction from the needles raised by the up pickers until all of the needles in the semicircle come to the knitting position, thereby to knit a rear side portion 4*b* integral with the front side portion 4*a* of the apron tipping portion 4.

Figure 2:
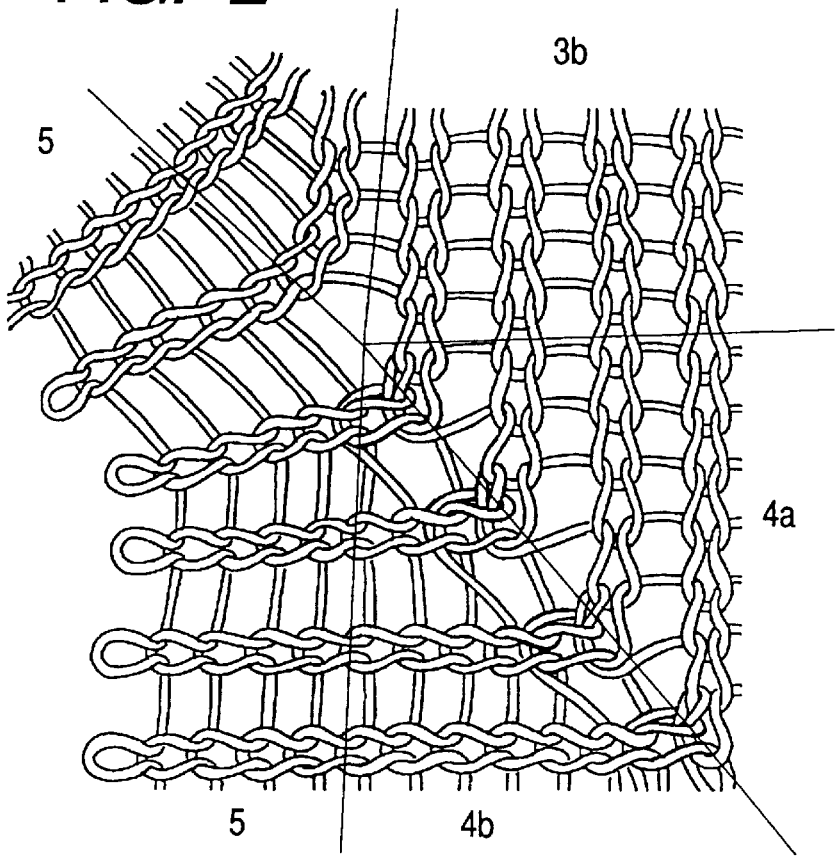
FIG. 2 is a partial enlarged view showing a knit textile of a base end portion of an apron tipping portion.

FIG. 2 is an enlarged view of a knitting texture of the apron tipping portion 4 on the base end side (front face left side portion A). The apron tipping portion 4 composed of a triangle bag-shaped knit fabric is formed by performing narrowing and widening for each two courses by each one forward and reverse rotation of the cylinder, that is, by each reciprocating movement of the cylinder, such that the front side portion 4*a* and the rear side portion 4*b* of a triangular shape are connected integrally to each other on the opposite sides thereof.

Figure 3:
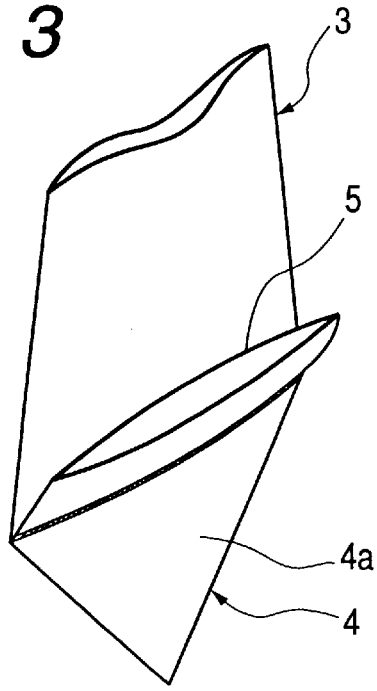
FIG. 3 is a perspective view of essential part showing the rear face side of the apron tipping portion of the necktie after knitted.

After the apron tipping portion 4 described above is knitted, the needles in the semicircle of the cylinder raised to the non-knitting level are lowered by the switch cam, and a waste course portion 5 is knitted as shown in FIG. 3 by full rotation of the cylinder using all of the knitting needles. This waste course portion 5 is knitted with a same knitting yarn as that of the body of the necktie after several courses are knitted with a thin yarn. Then, necktie body portions connecting to the waste course portion 5, that is, an end of the rear side portion of the front apron portion 3 and an end portion of the rear side portion 4*b* of the apron tipping portion 4 are set to a pointer of a linking machine, and the linking machine is operated to cut away the waste course portion 5 and automatically link the opening portion. Then, the knit necktie is completed by arranging the shape of the entire product flat by press finish with an iron.

The apron tipping portion 4 of the knit necktie formed in such a manner as described above does not exhibit a thick knit fabric as that of a conventional knit necktie obtained by seaming, and since also end edge portions of the triangular shape are formed by knitting of the knit fabric itself, they exhibit a natural finish while they are sharp when compared with that in a case wherein they are folded back by seaming independently of a knit textile as in the prior art.

It is to be noted that, while, in the embodiment described above, it is described that the rear apron portion 1 and the front apron portion 3 are so shaped as to be tapered individually in two stages by adjustment of the density and/or the change of the count of yarn, the present invention is not limited to this.

Since the knit necktie of the present invention is constructed in such a manner as described above, the apron tipping portion of a triangular shape can be formed by automatic knitting in a knitting process and special seaming need not be performed in a succeeding step as in the prior art. Further, also closing up of the opening portion of the rear side of the apron tipping portion can be performed by linking which is popular in a knitting process for a sock or stocking. Consequently, the operability is good, and besides such a situation that a seamed portion as in the case of seaming becomes thick is eliminated and also the appearance is good.

What is claimed is:

1. A knit necktie of a tubular knit fabric knitted continuously and having a triangular portion at an end thereof, wherein said triangular portion having a front face and a rear face to form the tubular triangular fabric end, each of the front and rear faces being approximately half the circumference of the tubular fabric, the front face decreasing in a widthwise direction at opposite ends of each consecutive course by a single stitch from a full width to a point, and the rear face increasing in the widthwise direction from the point to the full width by a single stitch in each consecutive course to form the triangular portion.

2. A knit necktie as set forth in claim 1, wherein an end of a rear face of the triangular portion and an end of the knit fabric on a rear face side of the tubular knit fabric are linked to each other to connect them and an opening portion of these ends are closed by linking.

3. A method of producing a knit necktie using a hosiery knitting machine comprising the steps of:

continuously knitting a rear portion, a neckband portion and a front portion of a knit necktie in a tubular knit fabric;

raising needles in a semicircular configuration of a circular knitting machine corresponding to a rear face side of a triangular portion to a non-knitting level and starting semicircle knitting by forward and reverse rotation of a cylinder;

decreasing stitches, one by one, on each of the opposite left and right sides for each forward and reverse rotation;

repeating the decreasing step until only two central stitches remain, thereby to knit a front side portion of the triangular portion;

increasing the stitches, one by one, on each of the opposite left and right sides for each forward and reverse rotation of said cylinder;

repeating the increasing step until all of the needles in the semicircular configuration of the circular knitting machine come to a knitting position, thereby to knit a rear side portion of the triangular portion integral with the front side portion of the triangular portion, thereby forming the triangular portion composed of a triangular tubular knit fabric;

returning the needles in the semicircle of the circular knitting machine which have been raised to the non-knitting level to the knitting level;

knitting a waste course portion composed of a short tubular knit fabric connecting to the rear side portion of the triangular portion and the rear face side portion of the front triangular portion by full rotation; and linking to connect the waste course portion by a linking machine.

* * * * *